US010895191B2

(12) United States Patent
Huffman et al.

(10) Patent No.: US 10,895,191 B2
(45) Date of Patent: Jan. 19, 2021

(54) FLUID COMPRESSOR AND METHOD OF OPERATING A FLUID COMPRESSOR TO REDUCE OIL CARRYOVER BY A COMPRESSOR PISTON ASSEMBLY

(71) Applicant: Bendix Commercial Vehicle Systems LLC, Elyria, OH (US)

(72) Inventors: Justin R Huffman, Eastlake, OH (US); Loren L Bruns, Shaker Heights, OH (US); Scott A Hidley, Avon, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 0 days.

(21) Appl. No.: 16/434,356

(22) Filed: Jun. 7, 2019

(65) Prior Publication Data

US 2020/0386143 A1 Dec. 10, 2020

(51) Int. Cl.

| | |
|---|---|
| ***F01P 1/04*** | (2006.01) |
| ***F01P 3/08*** | (2006.01) |
| B05B 1/14 | (2006.01) |
| ***F15B 15/14*** | (2006.01) |

(52) U.S. Cl.

CPC ..... *F01P 3/08* (2013.01); *B05B 1/14* (2013.01); *F15B 15/1447* (2013.01)

(58) Field of Classification Search

CPC ..... F01P 3/08; F01M 1/08

(Continued)

(56) References Cited

U.S. PATENT DOCUMENTS 4,129,108 A * 12/1978 Elsbett ..... F02F 3/22 123/193.6
4,206,726 A * 6/1980 Johnson, Jr. ..... F01P 3/08 123/41.35

(Continued)

FOREIGN PATENT DOCUMENTS

| | | | |
|---|---|---|---|
| CN | 108506193 | A | 9/2018 |
| DE | 3637196 | A1 | 5/1988 |
| KR | 20040061083 | A | 7/2004 |

OTHER PUBLICATIONS

Bendix Commercial Vehicle Systems, "Bendix BA-921 Compressor: Standard and Closed Room," Service Data Sheet, Oct. 2007, 40 pages, Bendix Commercial Vehicle Systems LLC, Elyria Ohio, U.S.A.

(Continued)

*Primary Examiner* — Long T Tran
*Assistant Examiner* — James J Kim
(74) *Attorney, Agent, or Firm* — Cheryl Greenly; Brian Kondas; Eugene Clair

(57) ABSTRACT

A compressor comprises a first compressor piston assembly including a first compressor piston head having a bottom side and a longitudinal central axis. The compressor also comprises a first nozzle arranged to direct a first oil stream towards the bottom side of the first compressor piston head to cool the piston assembly. The compressor further comprises a second nozzle arranged to direct a second oil stream towards the bottom side of the first compressor piston head to cool the piston assembly. Each of the oil streams is (Continued)

substantially parallel to each other and to the longitudinal central axis to provide a flow of oil to cool the piston assembly and to reduce an oil carryover by the first compressor piston assembly by up to about fifty percent as compared to a compressor having no nozzles directing oil streams towards the bottom side of the first compressor piston head.

8 Claims, 7 Drawing Sheets

(58) Field of Classification Search
USPC ..... 123/41.35
See application file for complete search history.

(56) References Cited

U.S. PATENT DOCUMENTS 6,250,275 B1 * 6/2001 Bock ..... F01M 1/08 123/196 R
7,360,510 B2 * 4/2008 Bontaz ..... F01P 3/08 123/41.35
2004/0040520 A1 * 3/2004 Bontaz ..... F01P 3/08 123/41.35
2008/0078339 A1 4/2008 Obermeier
2013/0206084 A1 * 8/2013 Azevedo ..... F02F 3/18 123/41.35
2015/0110647 A1 * 4/2015 Wilhelm ..... F04C 18/12 417/228
2017/0030292 A1 * 2/2017 Linke ..... F02F 3/22
2017/0350304 A1 * 12/2017 Yamashita ..... F01P 7/14
2018/0313239 A1 * 11/2018 Bennedsen ..... F01M 1/08
2018/0363537 A1 * 12/2018 Mark ..... B05B 1/06

OTHER PUBLICATIONS

European Patent Office, "Written Opinion and Search report of the International Searching Authority," Report, dated Aug. 21, 2020, 11 pages, Rijswijk Netherlands.

* cited by examiner

FLUID COMPRESSOR AND METHOD OF OPERATING A FLUID COMPRESSOR TO REDUCE OIL CARRYOVER BY A COMPRESSOR PISTON ASSEMBLY

BACKGROUND

The present application relates to compressors and is particularly directed to a fluid compressor and a method of operating a fluid compressor to reduce oil carryover by a compressor piston assembly.

Fluid compressors in the form of air compressors for trucks are known. One type of vehicle air compressor for trucks is a single-cylinder (one piston assembly) compressor having one piston assembly that is operatively coupled to a crankshaft in known manner. Another type of vehicle air compressor is a twin-cylinder (two piston assemblies) compressor having dual piston assemblies. Compressor piston assemblies are sometimes cooled using engine oil of the truck. The engine oil is typically splashed onto the cylinder wall from the crankshaft and connecting rod bearings or sprayed towards the bottom side (i.e., the non-working end) of a piston head of the piston assembly. The oil on the cylinder wall is required for lubrication of the piston assembly. Some of the oil on the cylinder wall passes around piston rings to the cylinder bore on the top side (i.e., the working end) of the piston head. The passing of oil from the non-working end of the piston head to the working end of the piston head is known as "oil carryover". The rate of oil carryover increases with piston/cylinder wall temperature. Some of this oil is then evaporated and carried out of the compressor in the pressurized discharge air (gas). Oil in the discharge air is a contaminant and can affect downstream components. Accordingly, those skilled in the art continue with research and development efforts in the field of vehicle air compressors to reduce oil carryover.

SUMMARY

In accordance with one embodiment, a fluid compressor comprises a first compressor piston assembly including a first compressor piston head having a bottom side and a longitudinal central axis. The fluid compressor also comprises a first nozzle arranged to direct a first oil stream towards the bottom side of the first compressor piston head to cool the first compressor piston assembly. The fluid compressor further comprises a second nozzle arranged to direct a second oil stream towards the bottom side of the first compressor piston head to cool the first compressor piston assembly. Each of the first and second oil streams is substantially parallel to each other and to the longitudinal central axis of the first compressor piston head thereby providing a flow of oil to cool the first compressor piston assembly and reducing an oil carryover by the first compressor piston assembly by up to about fifty percent as compared to a fluid compressor having no nozzles directing oil streams towards the bottom side of the first compressor piston head.

In accordance with another embodiment, a fluid compressor comprises a first compressor piston assembly including a first compressor piston head having a bottom side. The fluid compressor also comprises means for reducing oil carryover by the first compressor piston assembly while increasing total compressor oil flow towards the bottom side of the first compressor piston head to cool the first compressor piston assembly.

In accordance with yet another embodiment, a method is provided of operating a fluid compressor to reduce oil carryover by a compressor assembly having a compressor piston head. The method comprises directing a flow of compressor oil towards a bottom side of the compressor piston head to cool the compressor piston assembly. The method also comprises reducing oil carryover by the compressor piston assembly as the total compressor oil flow towards the bottom side of the compressor piston head increases from between about 1.5 liters/minute and about 2.0 liters/minute to between about 3.8 liters/minute and about 4.2 liters/minute.

DETAILED DESCRIPTION

The present application is directed to a fluid compressor. One application may be for a vehicle such as a truck. The specific construction of the fluid compressor may vary. It is to be understood that the disclosure below provides a number of embodiments or examples for implementing different features of various embodiments. Specific examples of components and arrangements are described to simplify the present disclosure. These are merely examples and are not intended to be limiting.

Figure 1:
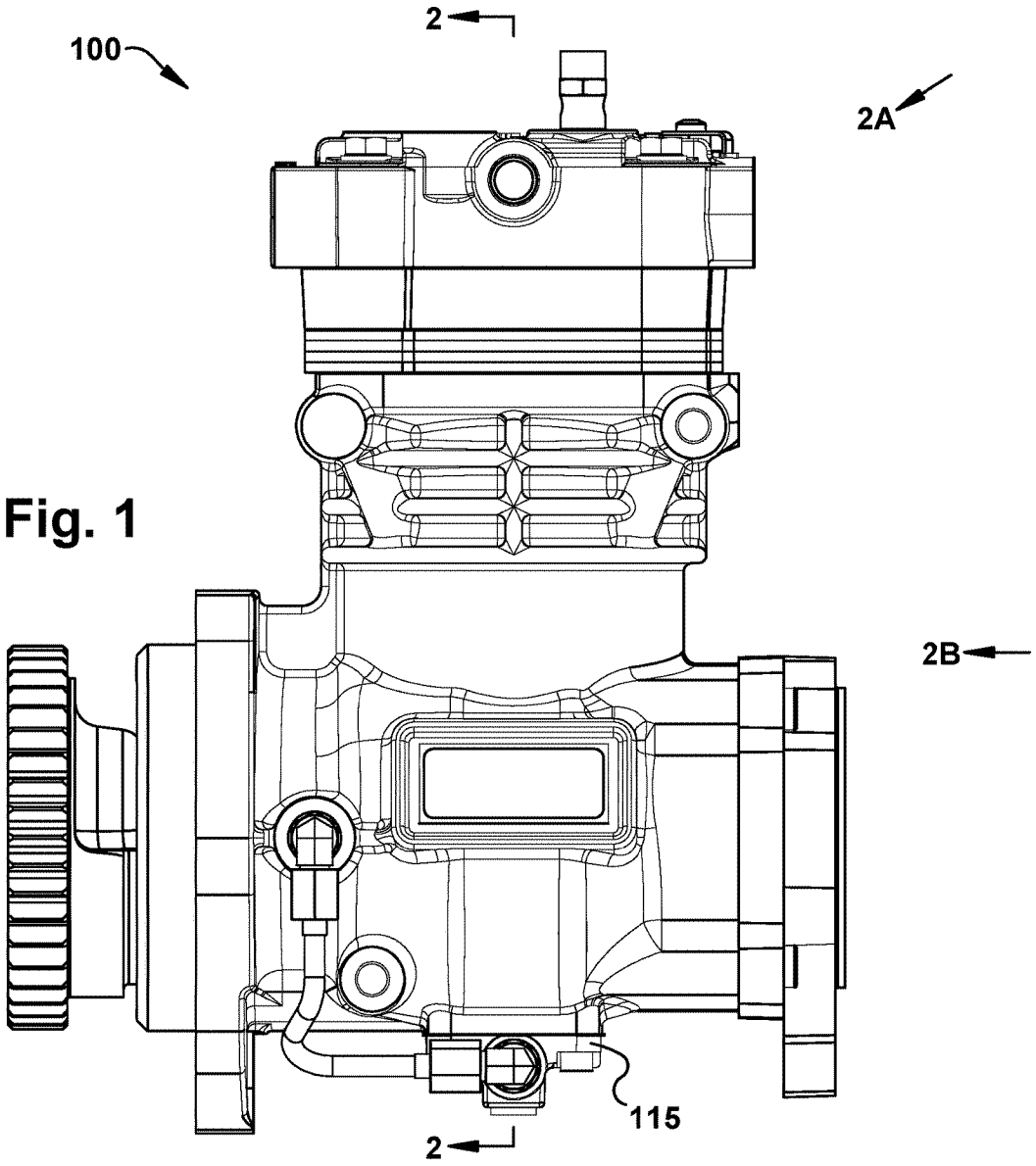
FIG. 1 is an elevational perspective view of an example vehicle air compressor constructed in accordance with an embodiment.
Figure 2B:
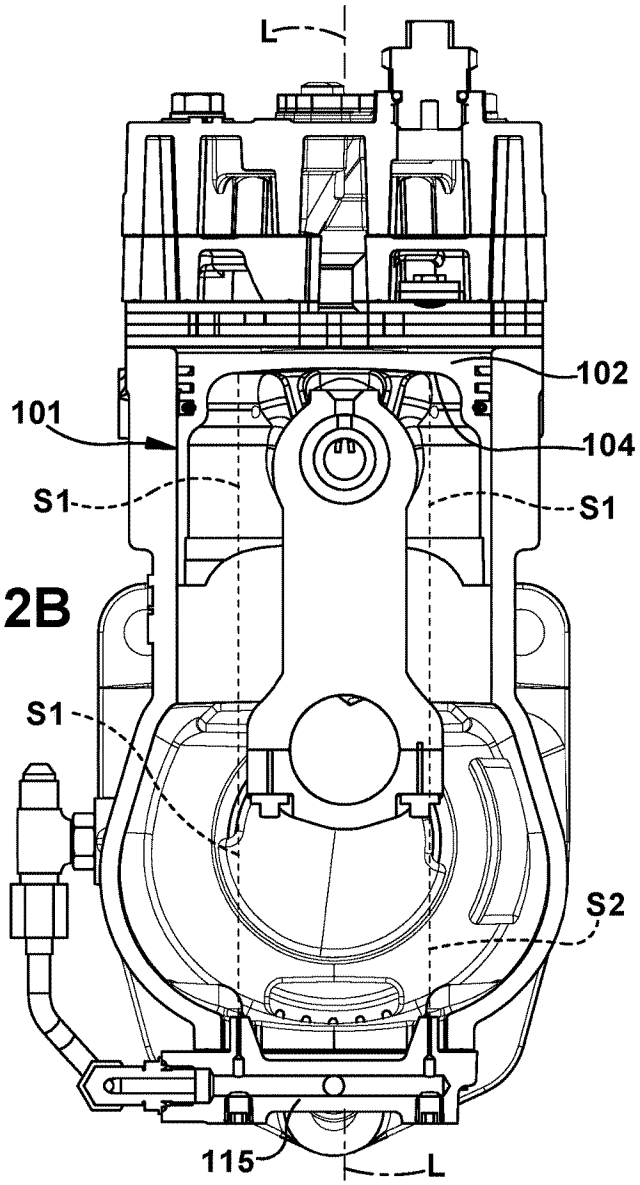
FIG. 2B is a sectional perspective view, taken approximately along line 2-2 of FIG. 1 and looking approximately in the direction of arrow "2B", showing compressor parts within the vehicle air compressor.
Figure 2A:
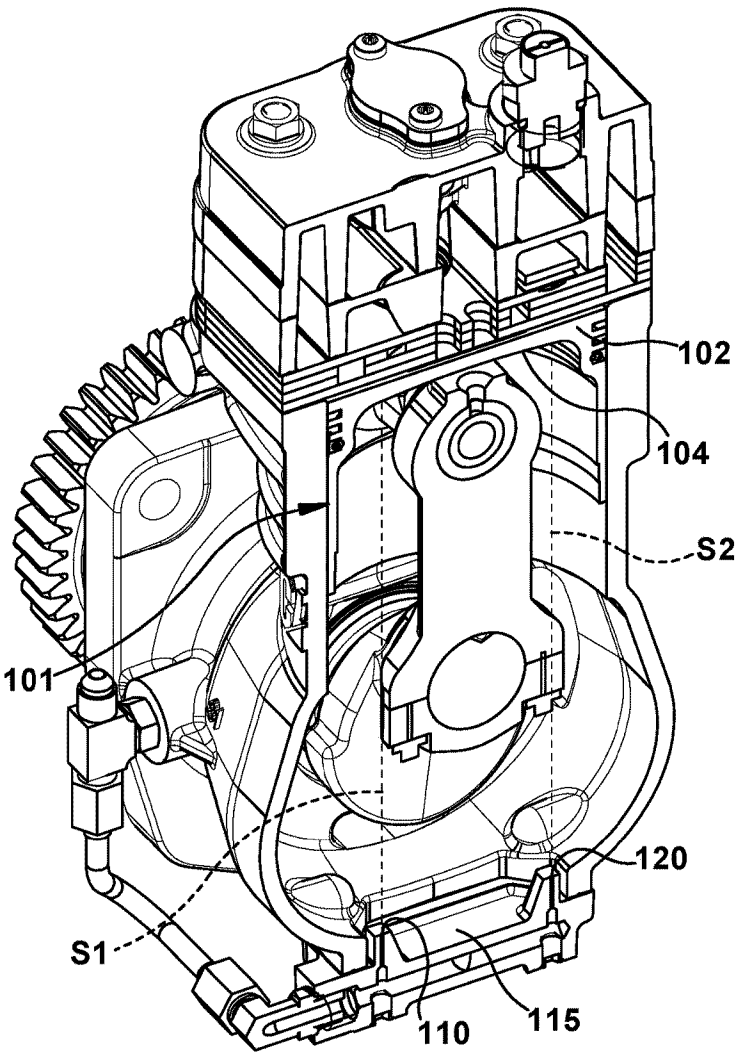
FIG. 2A is a sectional perspective view, taken approximately along line 2-2 of FIG. 1 and looking approximately in the direction of arrow "2A", showing compressor parts within the vehicle air compressor.

Referring to FIG. 1, an elevational perspective view of an example vehicle air compressor 100 constructed in accordance with an embodiment is illustrated. FIG. 2A is a sectional perspective view taken approximately along line 2-2 of FIG. 1 and looking approximately in the direction of arrow "2A". FIG. 2B is a sectional perspective view taken approximately along line 2-2 of FIG. 1 and looking approximately in the direction of arrow "2B". Each of FIGS. 2A and 2B shows compressor parts within the vehicle air compressor 100.

The vehicle air compressor 100 comprises a compressor piston assembly 101 including a compressor piston head 102 having a bottom side 104 and a longitudinal central axis "L". The vehicle air compressor 100 is a single-cylinder compressor. A first nozzle 110 is arranged to direct a first oil stream S1 towards the bottom side 104 of the compressor piston head 102 to cool the compressor piston assembly 101. A second nozzle 120 is arranged to direct a second oil stream S2 towards the bottom side 104 of the compressor piston head 102 to cool the compressor piston assembly 101. A bottom compressor body plate 115 defines the first and second nozzles 110, 120. The nozzles 110, 120 and internal flow passages can be machined or integrated into a single piece with the bottom compressor body plate 115.

Each of the first and second oil streams S1, S2 is substantially parallel to each other and to the longitudinal central axis L of the compressor piston head 102. Each of the first and second nozzles 110, 120 has a nozzle diameter between about 0.02 inch (0.5 mm) and about 0.04 inch (1.0 mm). The nozzle diameter is sized so that a jet stream of oil is created as it exits the nozzle. The nozzle diameter can be adjusted based on the expected oil pressure, flow, and oil types. Each of the first and second oil streams S1, S2 is directed transverse (e.g., perpendicular) to the bottom side 104 of the compressor piston head 102.

Figure 3:
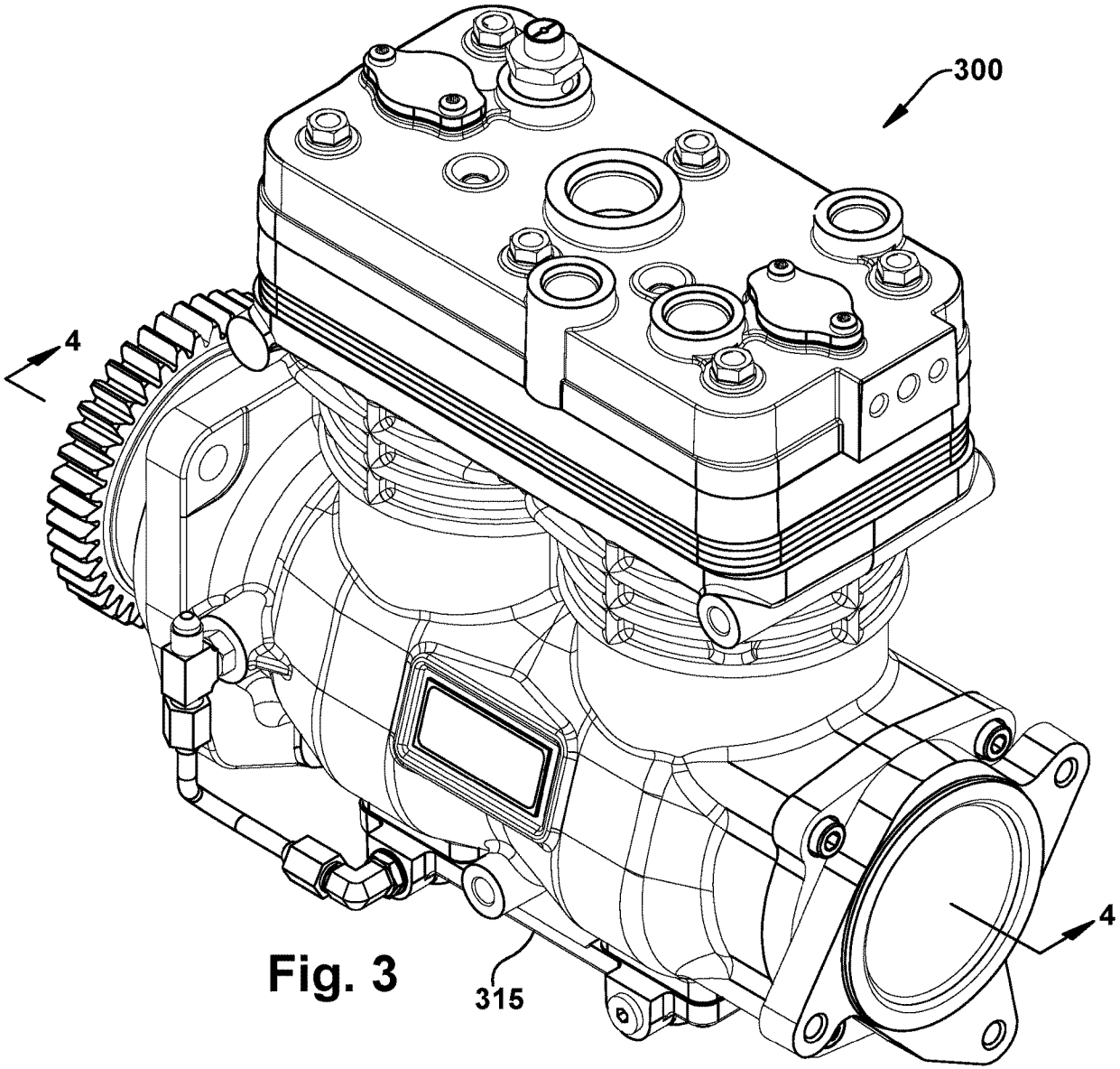
FIG. 3 is a perspective view of an example vehicle air compressor constructed in accordance with another embodiment.
Figure 4:
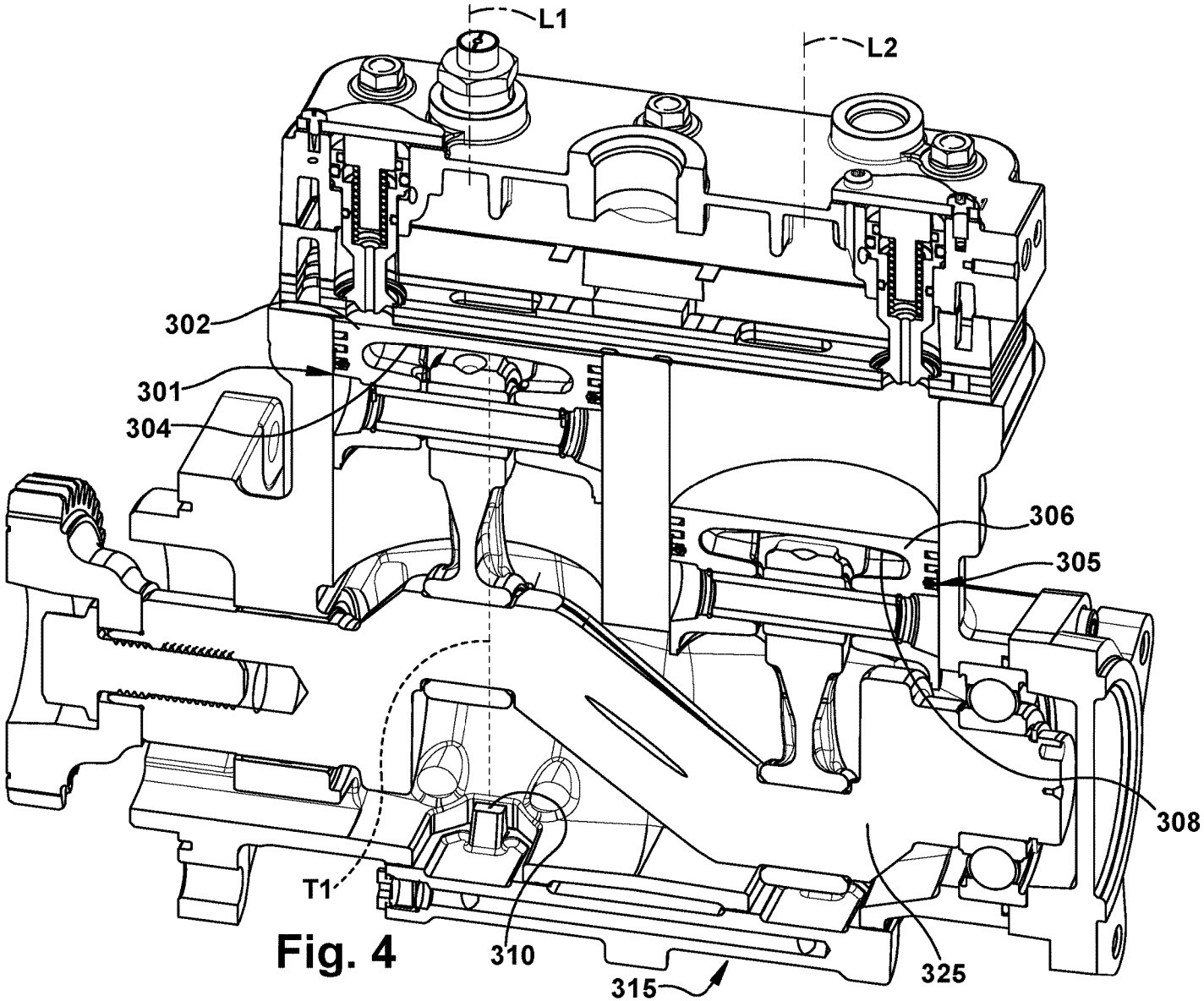
FIG. 4 is a sectional perspective view, taken approximately along line 4-4 of FIG. 3, showing compressor parts within the vehicle air compressor.

Referring to FIG. 3, a perspective view of an example vehicle air compressor 300 constructed in accordance with another embodiment is illustrated. FIG. 4 is a sectional perspective view taken approximately along line 4-4 of FIG. 3. FIG. 4 shows compressor parts within the vehicle air compressor 300.

Figure 5C:
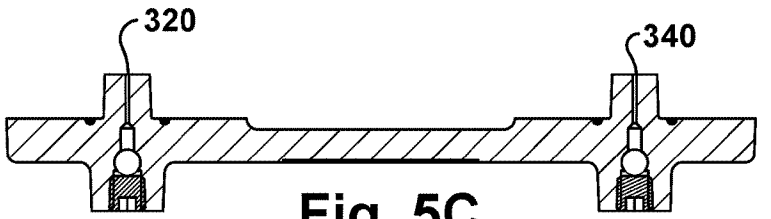
FIG. 5C is a sectional view taken approximately along line 5C-5C of FIG. 5B.
Figure 5D:
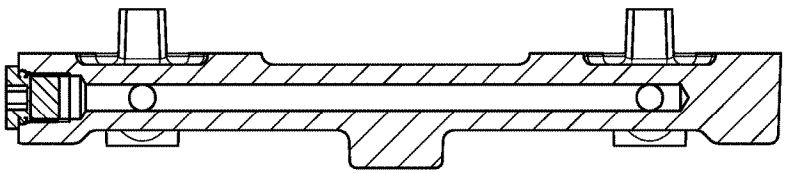
FIG. 5D is a sectional view taken approximately along line 5D-5D of FIG. 5B.
Figure 5E:
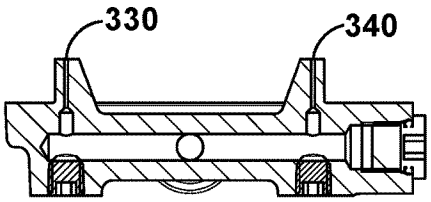
FIG. 5E is a sectional view taken approximately along line 5E-5E of FIG. 5B.
Figure 5A:
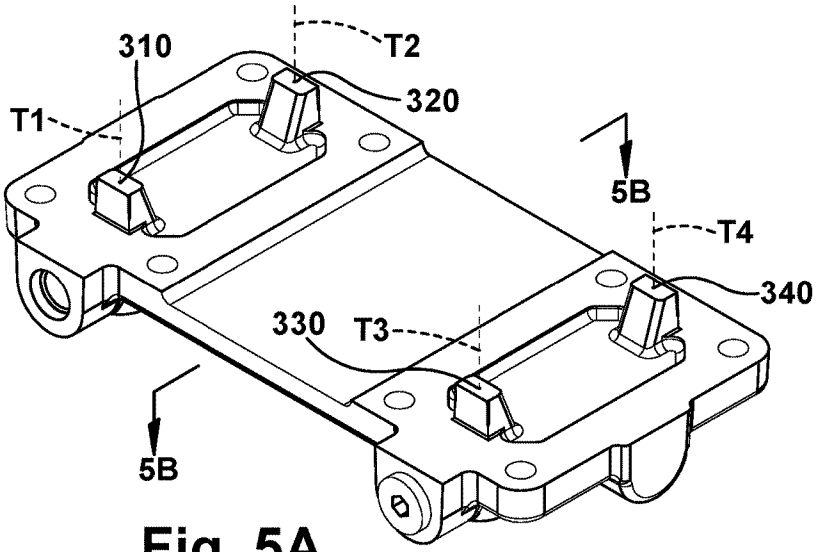
FIG. 5A is an enlarged perspective view of a compressor part of the vehicle air compressor of FIG. 3.
Figure 5B:
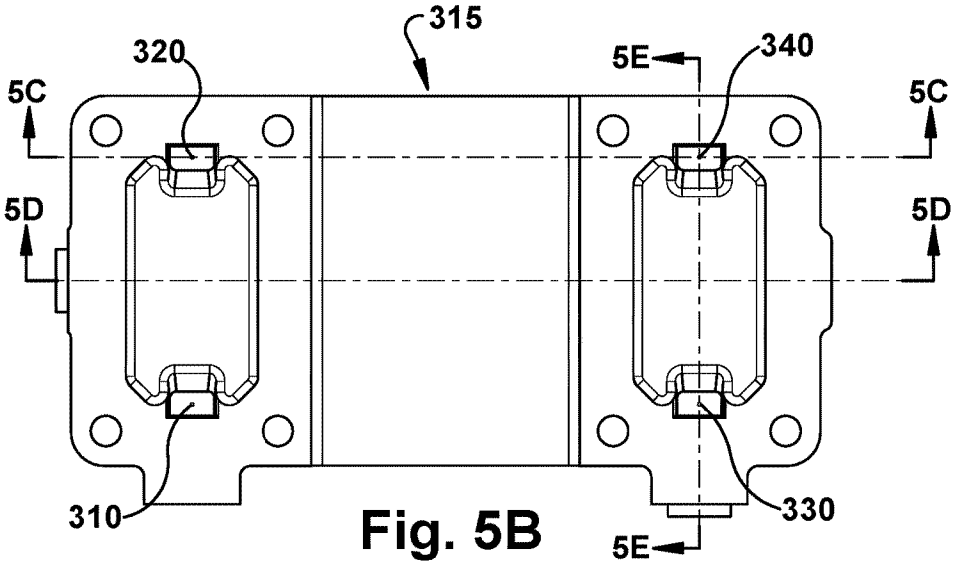
FIG. 5B is a top perspective view looking approximately in the direction of arrow "5B" of FIG. 5A.

Referring to FIG. 5A, an enlarged perspective view of a compressor part of the vehicle air compressor 300 of FIG. 3 is illustrated. FIG. 5B is a top perspective view looking approximately in the direction of arrow "5B" of FIG. 5A. FIG. 5C is a sectional view taken approximately along line 5C-5C of FIG. 5B. FIG. 5D is a sectional view taken approximately along line 5D-5D of FIG. 5B. FIG. 5E is a sectional view taken approximately along line 5E-5E of FIG. 5B.

The vehicle air compressor 300 comprises a first compressor piston assembly 301 including a first compressor piston head 302 having a bottom side 304 and a longitudinal central axis "L1". The vehicle air compressor 300 is a twin-cylinder compressor. A first nozzle 310 is arranged to direct a first oil stream "T1" towards the bottom side 304 of the first compressor piston head 302 to cool the first compressor piston assembly 301. A second nozzle 320 (not visible in FIG. 4) is arranged to direct a second oil stream "T2" (shown only in FIG. 5A) towards the bottom side 304 of the first compressor piston head 302 to cool the first compressor piston assembly 301.

Each of the first and second oil streams T1, T2 is substantially parallel to each other and to the longitudinal central axis L1 of the first compressor piston head 302. Each of the first and second oil streams T1, T2 is directed transverse (e.g., perpendicular) to the bottom side 304 of the first compressor piston head 302.

The vehicle air compressor 300 further comprises a second compressor piston assembly 305 including a second compressor piston head 306 having a bottom side 308 and a longitudinal central axis "L2". A third nozzle 330 (not visible in FIG. 4) is arranged to direct a third oil stream "T3" (shown only in FIG. 5A) towards the bottom side 308 of the second compressor piston head 306 to cool the second compressor piston assembly 305. A fourth nozzle 340 (also not visible in FIG. 4) is arranged to direct a fourth oil stream "T4" (also shown only in FIG. 5A) towards the bottom side 308 of the second compressor piston head 306 to cool the second compressor piston assembly 305.

Each of the third and fourth oil streams T3, T4 is substantially parallel to each other and to the longitudinal central axis L2 of the second compressor piston head 306. Each of the third and fourth oil streams T3, T4 is directed transverse (e.g., perpendicular) to the bottom side 308 of the second compressor piston head 306.

A bottom compressor body plate 315 (best shown in FIG. 5A) defines the first and second nozzles 310, 320. The bottom compressor body plate 315 also defines the third and fourth nozzles 330, 340. The nozzles 310, 320, 330, 340 and internal flow passages can be machined or integrated into a single piece with the bottom compressor body plate 315. Each of the first, second, third, and fourth nozzles 310, 320, 330, 340 has a nozzle diameter between about 0.02 inch (0.5 mm) and about 0.04 inch (1.0 mm). The nozzle diameter is sized so that a jet stream of oil is created as it exits the nozzle. The nozzle diameter can be adjusted based on the expected oil pressure, flow, and oil type.

An advantage of having multiple nozzles is that there is always at least one oil stream with an unobstructed path to a piston head as crankshaft 325 rotates about its axis. The multiple oil streams also contact different locations, thus wetting a larger surface area of a bottom side of a piston head, which improves cooling. Further, it is conceivable that the nozzles 310, 320, 330, 340, can be offset longitudinally along the axis of the crankshaft 325 so that a piston head is exposed for a longer time to an oil stream.

Figure 6:
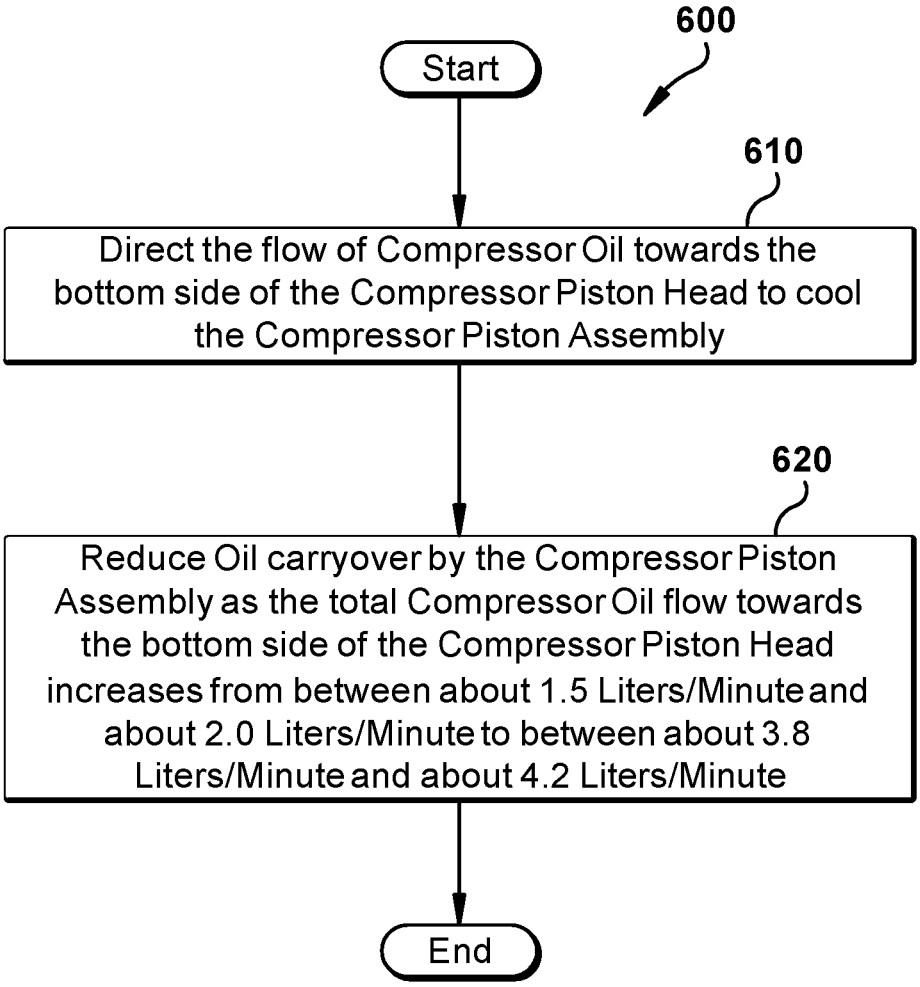
FIG. 6 is a flow diagram depicting an example method of operating the vehicle air compressor of FIG. 3 in accordance with an embodiment.

Referring to FIG. 6, a flow diagram 600 depicting an example method of operating the vehicle air compressor 300 of FIG. 3 in accordance with an embodiment is illustrated. A flow of compressor oil is provided for each of the first and second compressor piston heads 302, 306. In block 610, the flow of compressor oil is directed towards the bottom side 304, 308 of the compressor piston head 302, 306 to cool the compressor piston assembly 301, 305. Then in block 620, oil carryover by the compressor piston assembly 301, 305 is reduced as the total compressor oil flow towards the bottom side 304, 308 of the compressor piston head 302, 306 increases from between about 1.5 liters/minute and about 2.0 liters/minute to between about 3.8 liters/minute and about 4.2 liters/minute. The process then ends.

In some embodiments, the oil carryover is in a range between about 0.8 grams/hour and about 1.2 grams/hour when the total compressor oil flow towards the bottom side of the compressor piston head is between about 1.5 liters/minute and about 2.0 liters/minute.

In some embodiments, the oil carryover is in a range between about 0.7 grams/hour and about 0.9 grams/hour when the total compressor oil flow towards the bottom side of the compressor piston head is between about 2.5 liters/minute and about 3.0 liters/minute.

In some embodiments, the oil carryover is in a range between about 0.4 grams/hour and about 0.5 grams/hour when the total compressor oil flow towards the bottom side of the compressor piston head is between about 3.8 liters/minute and about 4.2 liters/minute.

In some embodiments, the total compressor oil flow is under a vehicle engine pressure of between about 40 pounds per square inch (2.76 bar) and about 43 pounds per square inch (2.96 bar).

Figure 7:
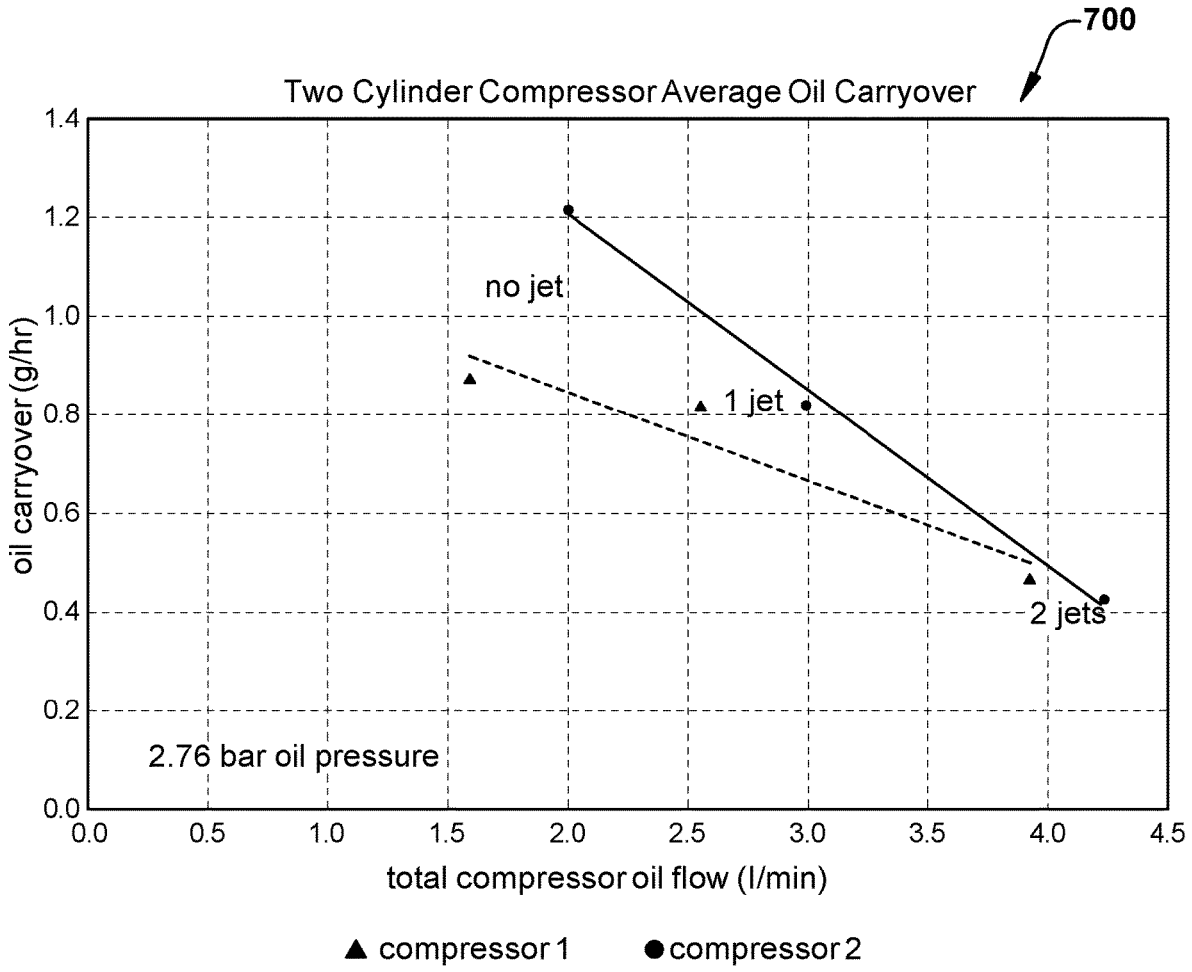
FIG. 7 is an example graph depicting operation of the vehicle air compressor of FIG. 3.

Referring to FIG. 7, an example graph 700 depicting operation of the vehicle air compressor 300 of FIG. 3 is illustrated. More specifically, FIG. 7 contains empirical data showing the average oil carryover (i.e., the average oil passing in units of grams/hour) at different total compressor oil flows (in units of liters/minute) for two different twin-cylinder air compressors (designated as "compressor 1" and "compressor 2". For each compressor, the average oil carryover decreases as the total compressor oil flow increases.

The oil flow values listed in the data are for total compressor oil flow, not just the oil flow to bottom side of piston head. The oil flow values are shown for a particular compressor piston size and will need to vary for different piston sizes. The oil stream directed at bottom side of piston head is better formed allowing more of the oil stream to impact bottom side of piston head.

The empirical data of FIG. 7 clearly shows that the effect of lowering oil carryover can be accomplished by only one jet per piston. By adding a second oil jet, the oil distribution on bottom side of piston head is improved. The improved oil distribution improves the cooling effect to further reduce oil carryover. The oil distribution and cooling effect on bottom side of piston head can be accomplished by any number of oil jets. By having oil jets, the oil carryover can be reduced up to about fifty percent as compared to a fluid compressor having no oil jets.

In accordance with an aspect of the present disclosure, the average oil carryover by each compressor piston head is reduced while the total compressor oil flow towards the bottom side of the compressor piston head is being increased to cool the compressor piston assembly. This inverse relationship between the average oil carryover and the total compressor oil flow in the designated ranges is an unexpected result. Notably, the total compressor oil flow is in a designated range between about 1.5 liters/minute and about 4.5 liters/minute. The oil carryover decreases in a designated range between about 1.2 grams/hour and about 0.4 grams/hour as the total compressor oil flow increases in the designated range between about 1.5 liters/minute and about 4.5 liters/minute.

The above-described arrangement of nozzles in the disclosed operating ranges provides optimum cooling for the associated compressor piston assembly while reducing oil carryover. Optimum cooling is provided because the oil streams from the nozzles are running substantially parallel to the longitudinal central axis of the compressor piston head. This allows a maximum amount of oil to be directed towards the bottom side of the compressor piston head. This also allows the oil stream to be directed with maximum flow towards the bottom side of the compressor piston head. The result is optimum cooling of the compressor piston assembly with reduced oil carryover as the total compressor oil flow towards the bottom side of the compressor piston head increases. This is especially beneficial in high duty cycle compressors.

While the present invention has been illustrated by the description of example processes and system components, and while the various processes and components have been described in detail, applicant does not intend to restrict or in any way limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. An air brake system twin-cylinder fluid compressor comprising:

a first compressor piston assembly including a first compressor piston head having a bottom side and a longitudinal central axis;

a second compressor piston assembly including a second compressor piston head having a bottom side and a longitudinal central axis;

a bottom compressor body plate defining a first nozzle, a second nozzle, a third nozzle, and a fourth nozzle;

the first nozzle arranged to direct a first oil stream towards the bottom side of the first compressor piston head to cool the first compressor piston assembly; and the second nozzle arranged to direct a second oil stream towards the bottom side of the first compressor piston head to cool the first compressor piston assembly, wherein each of the first and second oil streams is substantially parallel to each other and to the longitudinal central axis of the first compressor piston head;

the third nozzle arranged to direct a third oil stream towards the bottom side of the second compressor piston head to cool the second compressor piston assembly; and the fourth nozzle arranged to direct a fourth oil stream towards the bottom side of the second compressor piston head to cool the second compressor piston assembly, wherein each of the third and fourth oil streams is substantially parallel to each other and to the longitudinal central axis of the second compressor piston head; each of the first, second, third and fourth nozzle providing a flow of oil to cool the first compressor piston assembly and the second compressor piston assembly and reducing an oil carryover by the first compressor piston assembly and the second compressor piston assembly by up to about fifty percent as compared to an air brake system twin-cylinder fluid compressor having no nozzles directing oil streams towards the bottom side of the first compressor piston head and the second compressor piston head.

2. The fluid compressor according to claim 1, wherein each of the first, second, third, and fourth nozzles has a nozzle diameter between about 0.02 inch (0.5 mm) and about 0.04 inch (1.0 mm).

3. The fluid compressor according to claim 1, wherein each of the first and second oil streams is directed perpendicular to the bottom side of the first compressor piston head, and each of the third and fourth oil streams is directed perpendicular to the bottom side of the second compressor piston head.

4. The fluid compressor according to claim 1, wherein the first and second nozzles are longitudinally offset from each other along a crankshaft axis of the compressor.

5. A method of operating a fluid compressor to reduce oil carryover by a twin-cylinder air brake compressor assembly having two compressor piston heads, the method comprising:

directing a flow of compressor oil through a first and a second nozzle towards a bottom side of a first compressor piston head and directing a flow of compressor oil through a third and a fourth nozzle toward a bottom side of a second compressor piston head to cool the compressor piston assembly; and reducing oil carryover by the compressor piston assembly as compared to a twin-cylinder air brake compressor having no nozzles by cooling the compressor piston assembly as the total compressor oil flow towards the bottom side of the compressor piston head increases from between about 1.5 liters/minute and about 2.0 liters/minute to between about 3.8 liters/minute and about 4.2 liters/minute.

6. The method according to claim 5, wherein the oil carryover is in a range between about 0.8 grams/hour and about 1.2 grams/hour when the total compressor oil flow towards the bottom side of each compressor piston head is between about 1.5 liters/minute and about 2.0 liters/minute.

7. The method according to claim 6, wherein the oil carryover is in a range between about 0.7 grams/hour and about 0.9 grams/hour when the total compressor oil flow towards the bottom side of each compressor piston head is between about 2.5 liters/minute and about 3.0 liters/minute.

8. The method according to claim 7, wherein the oil carryover is in a range between about 0.4 grams/hour and about 0.5 grams/hour when the total compressor oil flow towards the bottom side of each compressor piston head is between about 3.8 liters/minute and about 4.2 liters/minute.

* * * * *